US005225133A

United States Patent [19]

Ihara et al.

[11] Patent Number: 5,225,133

[45] Date of Patent: Jul. 6, 1993

[54] METHOD FOR MANUFACTURING A GOLF BALL MOLD

[75] Inventors: Keisuke Ihara; Jumei Harada, both of Yokohama, Japan

[73] Assignee: Bridgestone Corporation, Tokyo, Japan

[21] Appl. No.: 735,220

[22] Filed: Jul. 24, 1991

[30] Foreign Application Priority Data

Jul. 26, 1990 [JP] Japan ..... 2-200756

[51] Int. Cl.[5] ..... B29C 33/40

[52] U.S. Cl. ..... 264/163; 264/221; 264/227

[58] Field of Search ..... 264/221, 225, 226, 227, 264/220, 317, 162, 163

[56] References Cited

U.S. PATENT DOCUMENTS

| | | | |
|---|---|---|---|
| Re. 28,826 | 5/1976 | Ladney, Jr. | 264/226 |
| 1,544,929 | 7/1925 | Pack | 164/132 |
| 2,388,776 | 11/1945 | Wallace | 264/225 |
| 3,188,370 | 6/1965 | Gotzy | 264/226 |
| 3,548,050 | 12/1970 | Mozar | 264/227 |
| 3,565,978 | 2/1971 | Folger et al. | 264/227 |
| 4,213,238 | 7/1980 | Gudorf | 264/225 |

*Primary Examiner*—Jay H. Woo
*Assistant Examiner*—Robert B. Davis
*Attorney, Agent, or Firm*—Sughrue, Mion, Zinn, Macpeak & Seas

[57] ABSTRACT

Golf balls are manufactured by supplying a golf ball - forming material into a mold defining a cavity of a predetermined surface pattern, thereby forming a golf ball having a surface pattern transferred from the mold cavity surface pattern. The mold is prepared by way of electroforming. First using an elastic non-metal profiling material, a male duplicate master is fabricated from a female standard mold having at least one accessory for assisting molding or post machining such as a parting surface and reference surface. An electroformed mold is fabricated from the male duplicate master. This electroformed mold is ready for use as the ball manufacturing mold.

6 Claims, 5 Drawing Sheets

METHOD FOR MANUFACTURING A GOLF BALL MOLD

This invention relates to a method for manufacturing golf balls.

BACKGROUND OF THE INVENTION

In the past, golf balls were manufactured by molding a molding material in a mold cavity having a suitable surface pattern. For example, one - piece golf balls were often manufactured by supplying a molding material into a mold cavity. Multi - layer golf balls (e.g., two - piece golf balls) and thread - wound golf balls were often produced by placing a preformed core in a mold cavity at its center and supplying a molding cover material into the space between the mold cavity surface and the core, followed by, molding. In either case, there were obtained golf balls having a surface pattern transferred from the cavity surface pattern.

These methods for molding golf balls used molds which were most often fabricated by precision casting and pressing.

The precision casting method is described with reference to the accompanying figures, FIGS. 14 to 17. The method includes the steps of first making a male master model a of brass or the like as shown in FIG. 14, forming a silicone rubber reverse mold b as shown in FIG. 15 therefrom, forming a gypsum mold c as shown in FIG. 16 therefrom, and finally forming a golf ball manufacturing mold d of beryllium copper or tool steel as shown in FIG. 17 from the gypsum mold c. The pressing method is designed to fabricate molds by pressing a master model of hard alloy having dimple - shaped depressions into a semi - spherical cavity of a preformed mold free of dimple - forming projections under high pressure, thereby transferring the dimple shapes to the latter in the plastic deformation region. The molds are usually made of zinc alloy or stainless steel.

Nevertheless, the mold fabricated by the prior art precision casting and pressing methods are unsatisfactory in precision. More particularly, the precision considerations for golf ball manufacturing molds are mold sphericity and the precision of all dimples in a single mold (precision of transfer from the master). In the precision casting method, sphericity is adversely affected by cooling shrinkage upon casting. In addition, for great many reversal operations from the master model until the fabrication of final molds and other reasons, the dimples in the final molds obtained from the same master model significantly vary in size and such size variations are inconsistent among dimples in a single mold and among molds. On the other hand, the pressing method fabricates molds by utilizing the plastic deformation of metal as mentioned above. Since spring - back always takes place on the material surface due to stress release upon removal of the master model, it is basically difficult to reproduce dimple shapes faithful to the master model dimple shapes, resulting in insufficient dimple precision. From a sphericity standpoint, removal of the master model is always accompanied by undercutting which results in insufficient sphericity at the mold parting line surface.

Attempts were made to utilize electro-forming for fabricating of golf ball-manufacturing molds. Molds are fabricated by first forming a master model of brass or the like, conducting electroforming on the master model, and thereafter dissolving away the master model, leaving the electroformed layer serving as the mold. This electroformed mold is fully improved in precision. However, when it is desired to use a mold having a plurality of cavities for manufacturing a corresponding plurality of golf balls, this electroforming method requires a plurality of master models of the same shape. In addition, after an electroformed mold has been fabricated, the mold has to be machined with necessary accessories including post - machining aids such as a post-machining reference surface and molding aids such as a parting surface, pin aperture(s), runner, gate, and spew, greatly adding to the cost.

SUMMARY OF THE INVENTION

Therefore, an object of the present invention is to provide a simple, cost efficient method for manufacturing golf balls having a dimple profile correctly transferred and high sphericity.

This and other objects are achieved by a method for manufacturing a golf ball according to the present invention. A golf ball - forming material is admitted into a mold defining a cavity of a predetermined surface pattern, thereby forming a golf ball having a surface pattern transferred from the mold cavity surface pattern. The mold is prepared by furnishing a female standard mold with at least one accessory for assisting molding or post machining. The accessory for assisting molding includes a parting surface, pin aperture, runner, gate and spew, and the accessory for assisting post machining includes a reference surface for post machining. A male duplicate master of an elastic non - metal profiling material is fabricated from the female standard mold. An electroformed mold is then fabricated from the male duplicate master. This electroformed mold is used as the golf ball manufacturing mold.

ADVANTAGES

The mold used for molding golf balls in accordance with the present invention is an electroformed mold as fabricated above. This electroformed mold has a cavity surface pattern correctly transferred from the standard mold and high sphericity so that golf balls of quality are manufactured at low cost without a variation among lots. The mold is obtained by fabricating a male duplicate master of an elastic non - metal profiling material from a female standard mold, and fabricating an electroformed mold from the duplicate master. Thus a plurality of duplicate masters can be produced from the single standard model, and consequently, a plurality of electroformed molds can be produced from the single standard model. Since the use of the elastic profiling material to produce duplicate masters causes no wear or damage to the standard mold, the standard mold remains sound after repeated use. Further, since the duplicate masters obtained from the standard mold are formed of the elastic, non - metallic, profiling material, the internal surface of the standard mold can be transferred to the duplicate masters with high precision and the profiling material elasticity helps remove the duplicate masters from the standard mold without an undercutting problem and without altering the dimple shapes transferred. As a result, the duplicate masters are of increased precision in both dimple configuration and sphericity. Therefore, the electroformed molds or golf ball manufacturing molds obtained from the duplicate masters also having high precision so that golf balls of high precision are manufactured.

In one preferred embodiment, the duplicate master is produced by placing a hard core and forming a thin layer of elastic non - metal profiling material (preferably about 0.1 to 5 mm thick) on the core in close conformity to the standard mold cavity. Then the profiling material can reproduce dimple shapes more correctly and show higher sphericity since it is supported and reinforced by the core.

Moreover, in accordance with the present invention, the female standard mold is previously provided with accessories for assisting molding and post machining, for example, accessories for assisting molding including a parting surface, pin aperture, runner, gate and spew, and accessories for assisting post machining including a reference surface for post machining. A duplicate master is fabricated from the standard mold using an elastic non - metal profiling material, and an electroformed mold is then fabricated from the duplicate master, which is almost ready for use as a mold for manufacturing golf balls. The present invention simplifies post machining as required in the prior art after the completion of an electroformed mold, and especially eliminates the need to machine complexly configured portions, thus greatly reducing the manufacture cost of the mold and therefore, of golf balls.

BRIEF DESCRIPTION OF THE DRAWINGS

FIG. 2 being an elevation of a male master model; FIG. 3 being a partially cross sectional elevation of the master model having an electroformed layer thereon; FIG. 4 being a cross section of a female standard mold; FIG. 5 is a partially cross sectional elevation of the standard mold with the core on the body pressed therein; FIG. 6 is a cross section of the body taken along lines V—V in FIG. 5; FIG. 7 being a cross section of a duplicate master; and FIG. 8 being a partially cross sectional elevation of the duplicate master having an electroformed layer thereon.

FIG. 9 being a cross section of a female standard mold; FIG. 10 is a partially cross sectional elevation of the standard mold with the core on the body pressed therein; FIG. 11 being cross section of a duplicate master; FIG. 12 being a partially cross sectional elevation of the duplicate master having an electroformed layer thereon; and FIG. 13 being a cross section of the golf ball manufacturing mold fabricated by this process.

FIG. 14 being an elevation of a master model; FIG. 15 being a cross section of a silicone rubber reverse mold; FIG. 16 is an elevation of a gypsum mold; and FIG. 17 being a cross section of the thus fabricated mold.

Like parts are designated by the same numerals throughout the following description.

DESCRIPTION OF THE PREFERRED EMBODIMENT

The method for manufacturing golf balls according to the present invention is a molding method using a mold defining a cavity of a predetermined surface pattern. One - piece balls are manufactured by supplying a molding material into the mold cavity. Multi - layer structured solid balls and thread - wound balls are manufactured by placing a preformed core in the mold cavity at its center and supplying a molding or cover material into the space between the core and the mold cavity. There are formed golf balls each having a surface pattern transferred from the mold cavity surface pattern. The molding material may be selected from commonly used materials and the molding conditions are conventional.

The mold used in the method for manufacturing golf balls according to the present invention is an electroformed mold which is prepared by furnishing a female standard mold previously formed with at least one molding or post machining accessory, applying an elastic non - metal profiling material to the female standard mold to obtain a male duplicate master, and effecting electroforming on the male duplicate master to obtain the electroformed mold. The female standard mold may be prepared by forming a male master model for the golf ball from a metal such as brass in a conventional well - known manner, effecting electroforming on the male master to form an electroformed layer thereon, reinforcing the electroformed layer on its outer periphery with a backing material, and then dissolving away the male master model.

Figure 1:
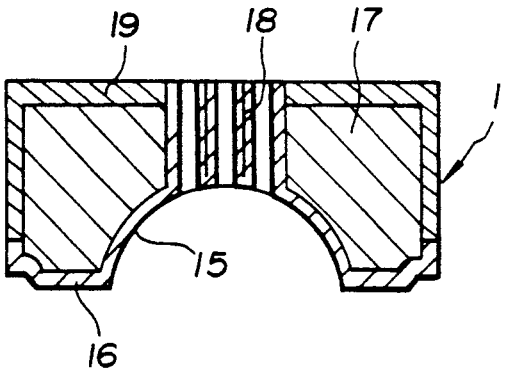
FIG. 1 is a cross section of one exemplary golf ball manufacturing mold used in the practice of the invention.
Figure 2:
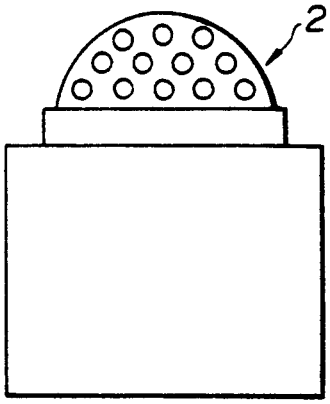
FIGS. 2 to 8 illustrate a process for fabricating the golf ball manufacturing mold.
Figure 3:
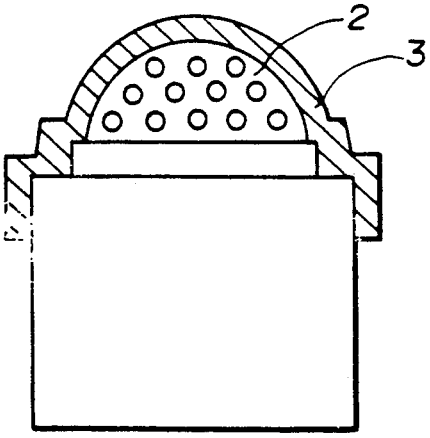

FIG. 1 illustrates an exemplary mold generally designated at 1 for use in the present method. The mold 1 is obtained by first furnishing a male master model 2 having the same surface pattern as the intended golf ball as shown in FIG. 2 and then forming an electroformed layer 3 on the surface of the male master model 2 as shown in FIG. 3. This electroforming may be carried out in a conventional manner using a nickel sulfamate bath or the like. Preferably, the electroformed layer 3 has a thickness of at least 0.3 mm, especially from about 3 to 8 mm. The master model 2 on which the electroformed layer 3 has been formed is thereafter removed by dipping in a chromic acid solution or another solution capable of dissolving away the master model 2. Therefore, the electroformed layer 3 should be formed of a material which is insoluble in the master model dissolving solution.

Figure 4:
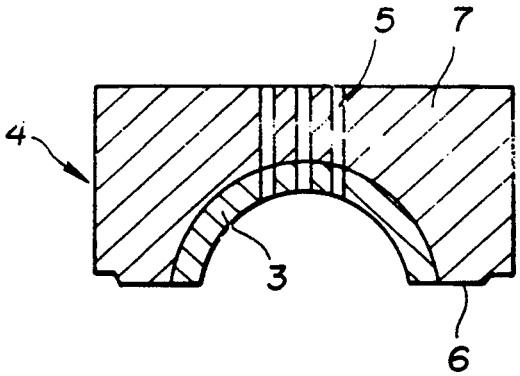

After electroforming, the electroformed layer 3 is machined with at least one accessory for assisting molding or post machining, for example, a molding accessory such as a parting surface, pin aperture, runner, gate and spew and a post machining accessory such as a reference surface for post machining. This machining is done by means of a lathe, milling machine, electric discharge milling machine or the like. Then the master model 2 is dissolved away. There is obtained a female standard electroformed mold 4 having a molding accessory such as pin apertures 5 and a spew surface 6 and reinforced with a backing material 7 as shown in FIG. 4. The machining may also be carried out after removal of the master model 2.

Next, a duplicate master is prepared from the female standard mold 4 by internally filling the female standard mold 4 with an elastic non-metal profiling material. The elastic non-metal profiling material used herein is preferably selected from vulcanized rubbers, especially cured silicone rubbers. The duplicate master may be solely formed of the profiling material although it is acceptable and recommended to embed a hard core in the profiling material, that is, to form a thin layer of profiling material on a hard core.

A mold obtained from the duplicate master solely formed of the profiling material has a higher precision than prior art molds and is especially improved in dimple reverse precision over the prior art molds. However, where the profiling material used is a rubber, the duplicate master formed therefrom has a possibility that he resulting mold be somewhat adversely altered in sphericity by deformations caused by internal stresses during subsequent electroforming, heat and stresses associated with outer periphery machining, and thermal expansion and shrinkage due to a temperature difference throughout the mold fabricating process. By using a hard core of a metal or similar hard material and forming thereon a profiling material layer having a surface in close conformity to the standard mold internal surface to a reduced thickness, preferably to a thickness of about 0.1 to 5 mm, there is obtained a reinforced duplicate master having higher strength so that the profiling material layer may experience minimal deformation. This ensures the preparation of a mold having significantly improved sphericity.

Figure 5:
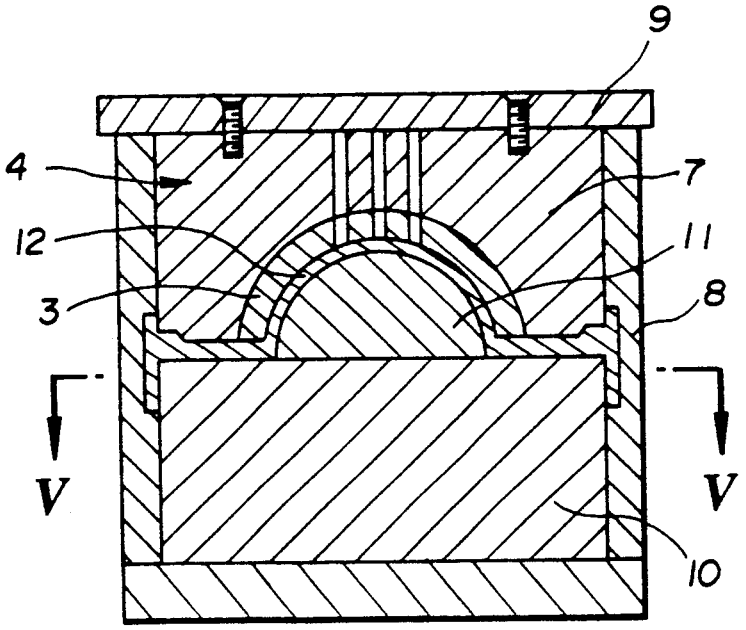
Figure 6:
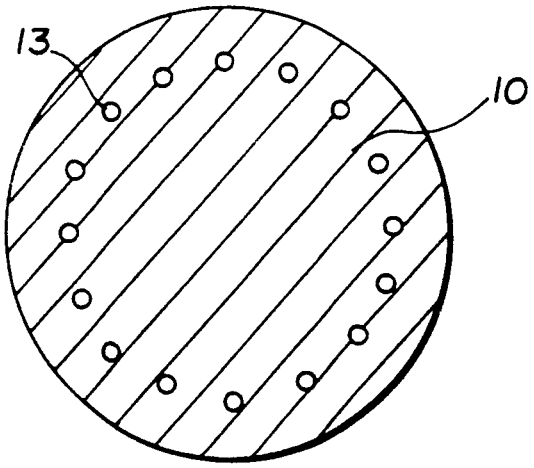

The core - implanted duplicate master is preferably prepared as shown in FIG. 5 by optionally attaching a guide ring 8 and a caul 9 to the standard mold 4, charging the cavity of the mold 4 with a necessary amount of profiling material, and forcing a semi - spherical core 11 on a forward surface of a body 10 toward the mold cavity. The core 11 has a diameter smaller than the inner diameter of the mold 4 and is preferably spaced about 0.1 to 5 mm from the inner surface of the mold 4 so that the profiling material layer 12 may be formed to a thickness corresponding to this spacing. Preferably, he body 10 has a plurality of vertically extending through holes 13 circumferentially arranged so as to circumscribe the outer circumference of the semi - spherical core 11 as shown in FIG. 6 so that excess profiling material may outflow from within the mold 4 through the holes 13. After the core 11 is forced in place, the profiling material is vulcanized and cured in a conventional manner if it is a rubber such as silicone rubber.

Figure 7:
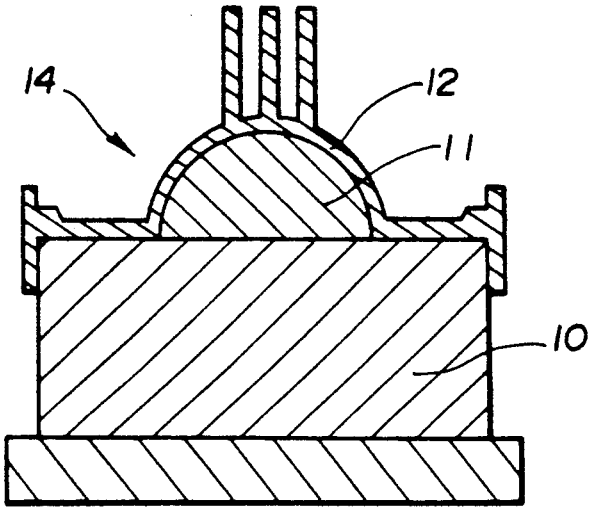

At this point, the profiling material layer 12 is in close contact with the standard mold 4. The profiling material layer 12 is then released from the standard mold 4 along with the core 11, obtaining a duplicate master 14 as shown in FIG. 7. The step of obtaining the duplicate master 14 according to the present invention causes no damage to the standard mold 4 and thus allows a plurality of duplicate masters to be produced by using the standard mold 4 repeatedly. Then a plurality of golf ball molds can be prepared from a plurality of duplicate masters by the following procedure.

Figure 8:
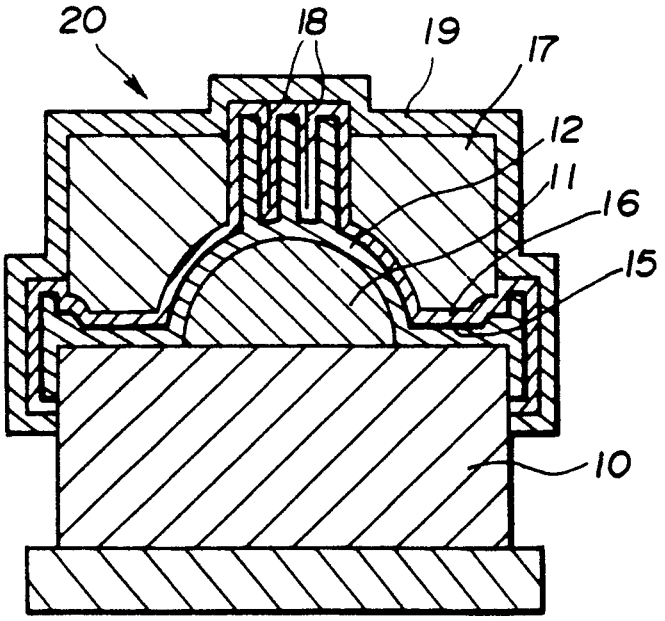

As shown in FIG. 8, the duplicate master 14 thus obtained is made electrically conductive on the outer surface of its profiling material layer 12. The technique for electric conduction is not critical and may be selected from well-known techniques for converting a non-conducting surface to a conducting surface, for example, silver mirror reaction, electroless plating, and vacuum deposition. After a conducting film 15 has been formed on the outer surface of the profiling material layer 12, electroforming is carried out to form an electroformed layer 16 formed of nickel, cobalt or nickel alloy such as Ni - Co, preferably to a thickness of at lest 0.3 mm, especially about 3 to 8 mm. No limit is imposed on the type of the electroformed layer 16 while it may be a single electroformed layer as illustrated in FIG. 8 or a multi - layer electroformed layer. In the case of a multi - layer construction, it is preferred to form an electroformed layer with less internal stresses as a lower layer and stack another electroformed layer thereon. One illustrative example uses a nickel - cobalt alloy layer plated from a corresponding sulfamate bath as the lower layer and a nickel layer plated from a corresponding sulfamate bath as the upper layer although the invention is not limited thereto.

If desired, the electroforming is followed by optional steps of processing the electroformed layer 16 on its outside surface, attaching an insert member 17 made of metal such as beryllium - copper, and filling a metal adhesive into a complex configuration 18 for reinforcement. Further, an outer metal layer 19 such as nickel, cobalt, nickel - cobalt alloy and the like may be formed on the electroformed layer 16 and the insert member 17 by the same electroforming method as above.

In this way, there is obtained a secondary electroformed mold 20 in close conformity to the duplicate master 14. It is then released from the duplicate master 14 and machined on the outside surface or parting line, if desired, resulting in the mold 1 for the manufacture of golf balls as shown in FIG. 1.

In the foregoing embodiment, the mold 1 for the manufacture of golf balls is prepared using the female standard mold in which accessories necessary for subsequent molding have been machined. In the preparation of the golf ball manufacturing mold according to the present invention, it suffices that at least one molding accessory be machined in the standard mold.

Figure 9:
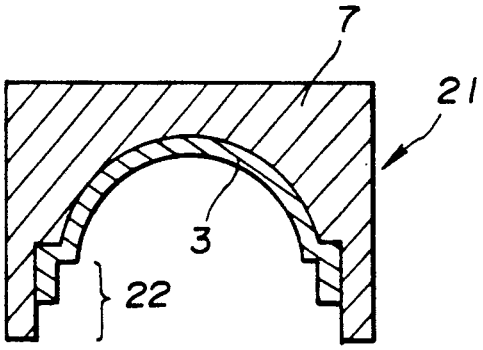
FIGS. 9 to 13 illustrate a process for fabricating another exemplary golf ball manufacturing mold.

Referring to FIG. 9, there is illustrated another exemplary standard mold generally designated at 21 in which a post machining reference surface 22 is preformed as the post machining accessory. The procedure of preparing a golf ball manufacturing mold using the standard mold 21 is described with reference to FIGS. 10 to 13. The standard mold 21 in FIG. 9 is prepared by the same procedure as described in conjunction with FIGS. 2 to 4 except that the post machining reference surface 22 is formed. In FIGS. 10 to 13, the same elements as in FIGS. 1 to 8 are designated by like numerals and their description is omitted.

Figure 10:
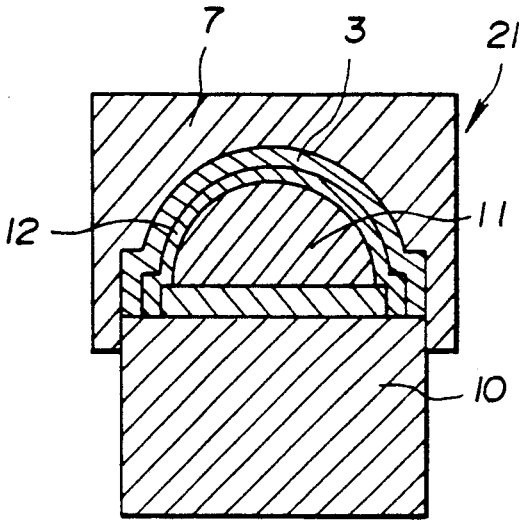

In FIG. 10, a profiling material layer 12 is formed by charging the cavity of the standard mold 21 with a necessary amount of profiling material, and forcing a semi - spherical core 11 resting on a body 10 toward the mold cavity in the same manner as in FIG. 5. It is to be noted that the body 10 has a plurality of vertically extending through holes 13 in the same manner as in FIG. 6.

Figure 11:
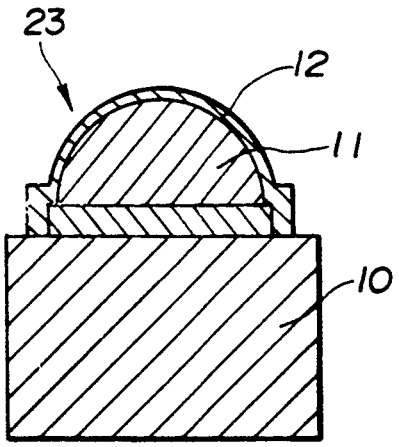
Figure 12:
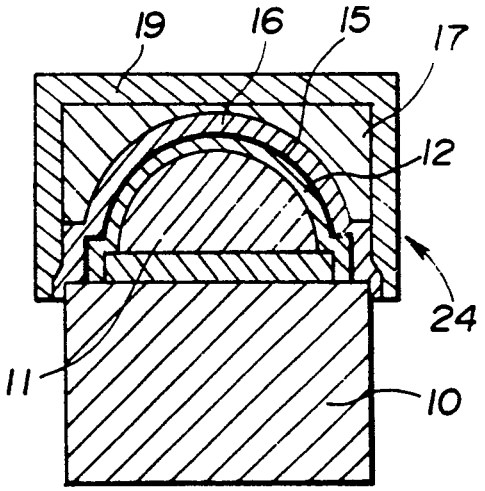
Figure 13:
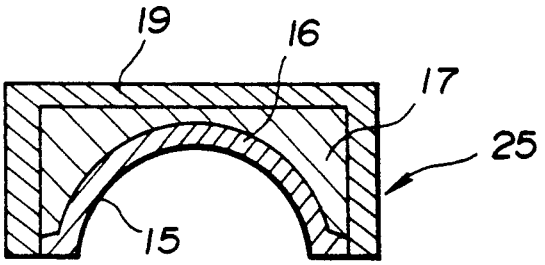
Figure 14:
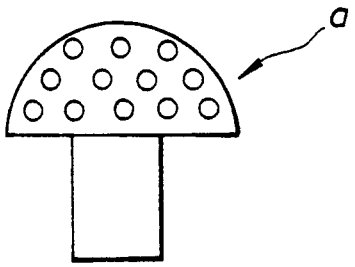
FIG. 14 PRIOR ART
FIG. 14 to 17 illustrate how to fabricate a golf ball manufacturing mold according to a prior art precision casting method.
Figure 15:
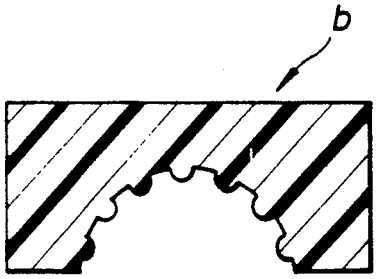
FIG. 15 PRIOR ART
Figure 16:
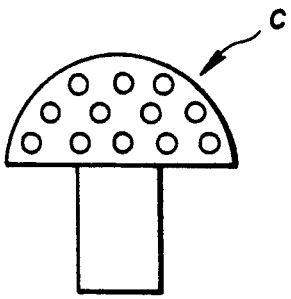
FIG. 16 PRIOR ART
Figure 17:
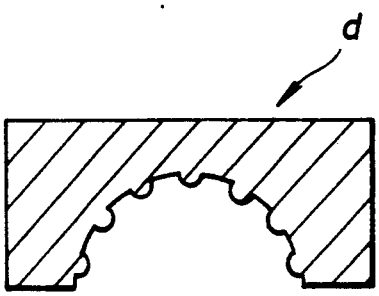
FIG. 17 PRIOR ART

After the core 11 is forced in place, the profiling material layer 12 is cured and then released from the standard mold 21 along with the core 11, obtaining a duplicate master 23 as shown in FIG. 11. Next steps are to subject the profiling material layer 12 of he duplicate master 23 to conducting treatment to form a conducting film 15 and to form an electroformed layer 16 as shown in FIG. 12. Then, an insert member 17 is attached and an outer electroformed layer 19 is formed. In this embodiment, the electroformed layer is a two - layer structure and such a multi - layer electroformed layer may be prepared by the procedure previously described in conjunction with FIG. 8. In this way, there is obtained a secondary electroformed mold 24 which is released from the duplicate master 23 and further machined on the outer periphery to complete a secondary electroformed mold 25 as shown in FIG. 13. The mold 25 is further machined with necessary molding assisting portions, obtaining a golf ball manufacturing mold.

By using the thus obtained mold in the molding of golf balls, there are manufactured golf balls having a precisely transferred dimple pattern and high sphericity in a simple and cost effective manner.

EXAMPLE

Examples are given below by way of illustrative and not by way of limitation.

Example 1

First, a male master model 2 for the intended golf ball was fabricated from brass as shown in FIG. 2. Nickel was then electroformed on the brass master model 2 to form an electroformed nickel layer 3 having a thickness of 5 mm or more as shown in FIG. 3. Then as shown in FIG. 4, the electroformed nickel layer 3 on the outer periphery was reinforced with a backing material 7, and a parting surface, pin apertures 5, a runner, a gate, and a spew 6 were machined. The assembly was dipped in a chromic acid solution to dissolve away the brass master model 2, obtaining a standard mold 4.

Next, a caul 9 was secured to the standard mold 4 by fastening screws as shown in FIG. 5. A fully debubbled silicone rubber (SH 9555 RTV by Toray Silicone K.K.) was cast into the mold cavity. A guide ring 8 was attached to a body 10 having a semi - circular core 11 with a diameter of 38.7 mm resting on the forward surface of the body. The core 11 was forcibly moved into the standard mold 4 to press the silicone rubber while allowing excess silicone rubber to exude from within the mold 4 through the holes 13 in the body 10. Then the assembly was placed in a constant temperature tank at 35° C. for 24 hours for curing the silicone rubber. Then the silicone rubber layer 12 tightly curred to the core 11 and the body 10 was released from the standard mold 4. This cured silicone rubber layer 12 had a thickness of 2 mm.

There was obtained a duplicate master 14 as shown in FIG. 7, which was subjected on the surface to silver mirror reaction for surface conduction, forming a metallic silver thin film 15. Electroforming in a nickel - cobalt alloy plating sulfamate bath yielded an electroformed Ni - Co layer 16 of about 3 mm thick. The electroformed Ni - Co layer 16 on the outer periphery was machined. A metal insert 17 which was machined from a tool alloy to a shape reverse to the electroformed layer 16 was bonded to the electroformed Ni - Co layer 16 with an epoxy base metal adhesive. The metal adhesive was also filled in a complex configuration 18 where the electroformed Ni - Co layer 16 has not fully filled in (so that some spaces were left empty). Nickel - cobalt electroforming was additionally conduced on the outer surface of the layer 16 to a thickness of about 1 mm until the predetermined dimensions were reached.

Finally, the electroformed layer was processed on the outer periphery, removed from the duplicate master 14 and further machined on the outer periphery, obtaining a golf ball manufacturing mold 1 as shown in FIG. 1.

Irrespective of simplified post machining thereon, the electroformed mold was satisfactory in dimensions and precision as demonstrated by the precision data reported in Table 1.

Two - piece golf balls were molded by placing a core in the cavity of the thus obtained mold and injection molding a cover material at 150° C. There were obtained balls having correctly sized dimples and correctly reproducing the interior pattern of the mold cavity without fins.

TABLE 1

| | Spherical surface | | Dimple (n = 10) | | | |
|---|---|---|---|---|---|---|
| | Diameter (mm) | Sphericity (mm) | Diameter (mm) | Variation R (mm) | Depth (mm) | Variation R (mm) |
| Brass master model | 43.00 | 0.002 | 3.60 | 0.03 | 0.300 | 0.004 |
| Example 1 | 43.00 | 0.010 | 3.60 | 0.04 | 0.300 | 0.006 |
| Prior art mold | | | | | | |
| Cast (SKD) | 42.22 | 0.065 | 3.62 | 0.07 | 0.270 | 0.015 |
| Cast (Be—Cu) | 42.32 | 0.040 | 3.62 | 0.06 | 0.280 | 0.012 |
| Pressed (SUS) | 43.07 | 0.030 | 3.61 | 0.05 | 0.285 | 0.010 |

Tester
spherical surface: three-dimensional meter by Tokyo Seimitu K.K.
dimples: optical section meter by Nissho Seimitu K.K.
Sphericity = maximum radium − minimum radius, based on 20 point measurements

Example 2

A standard mold 20 having an inner diameter of 42.7 mm as shown in FIG. 9 was prepared by the same procedure of preparing a standard electroformed mold as in Example 1 except that only a post machining preference surface was machined as the post machining accessory.

Next, as shown in FIG. 10, a fully debubbled silicone rubber (SH 9555 RTV by Toray Silicone K.K.) was cast into the standard mold 20 before a cured silicone rubber layer 12 of 2 mm thick was formed as in Example 1.

There was obtained a duplicate master 22 as shown in FIG. 11, which was subjected on the surface to silver mirror reaction for surface conduction, forming a metallic silver thin film 15 as shown in FIG. 12. Electroforming in a nickel - cobalt alloy plating sulfamate bath yielded an electroformed Ni - Co layer 16. After a metal insert 17 is provided, a Ni layer 19 was electroformed thereon using a nickel sulfamate plating bath, until the predetermined dimensions were reached. It is to be noted that excess portions on the first electroformed layer were machined off prior to the second electroforming stp such that the electroformed layer 19 was formed to the predetermined dimensions.

Finally, the electroformed Ni layer 19 on the outer periphery was machined by utilizing the reference surface (20 in FIG. 9). A secondary electroformed mold 24 obtained by releasing it from the duplicate master 23 was machined on the outer periphery and parting line, obtaining an electroformed mold 25 as shown in FIG. 13. This mold was free of a pin aperture.

This mold 25 had substantially the same dimension precision as the mold of Example 1.

The electroformed mold was ready for use as the golf ball manufacturing mold after it was machined with pin apertures.

Using this mold, one - piece golf balls were molded by approximately the same procedure as in Example 1. There were obtained balls having correctly sized dimples and correctly reproducing the interior pattern of the mold cavity without undercutting.

According to the present invention, a plurality of golf ball manufacturing molds free of any damage to dimple and other shapes can be fabricated from a single standard mold in a very precise manner. Since the standard mold has previously machined with an accessory necessary for subsequent molding or post machining, the golf ball manufacturing mold fabricated from the standard mold can simplify or facilitate post machining, with an attendant benefit of reducing the cost of the golf ball manufacturing mold and the cost of the golf balls.

While the invention has been described in what is presently considered to be preferred embodiments, other modifications and variations will become apparent to those skilled in the art. It is intended therefore that the invention not be limited to the specific embodiments shown, but be interpreted within the spirit and scope of the appended claims.

We claim:

1. A method for manufacturing a golf ball comprising the step of supplying a golf ball-forming material into a mold for forming the golf ball, said mold defining a cavity of a predetermined surface pattern corresponding to the outer periphery of the golf ball, wherein said mold being manufactured by a method comprising the steps of:

forming an electroformed layer on the outer surface of a male master model; machining said electroformed layer to form at least one accessory; removing said master model so as to form a female standard electroformed mold including said at least one accessory; placing a core within said female standard electroformed mold; injecting a material into the area between an outer periphery of said core and said female electroformed mold; removing the injected material layer from the female standard mold along with the core so as to form a male duplicate master mold having said at least one accessory; forming a conductive film on the outer surface of the injected material layer of the male duplicate master mold; forming a second electroformed layer on the conductive film so as to form an electroformed mold including said at least one accessory; and removing said electroformed mold from said male duplicate master, said removed electroformed mold being used as said mold for forming the golf ball.

2. The method of claim 1 wherein said accessory includes at least one of a parting surface, pin aperture, runner, gate and spew.

3. The method of claim 1 wherein said accessory for assisting post machining includes a references surface for post machining.

4. The method of claim 1 wherein said male duplicate master is fabricated by placing a hard core within said female standard electroformed mold and forming a thin layer of elastic non - metal profiling material on the core in close conformity to the standard mold cavity.

5. The method of claim 1, wherein said material injected into the area between an outer periphery of said core and said female electroformed mold is an elastic non-metal profiling material.

6. The method of claim 1, wherein said core is disposed about 0.1 to 5 mm from an inner surface of said female electroformed mold.

* * * * *